US011359319B2

(12) United States Patent
Choung et al.

(10) Patent No.: US 11,359,319 B2
(45) Date of Patent: Jun. 14, 2022

(54) INTELLIGENT WASHING MACHINE AND METHOD FOR CONTROLLING BALL BALANCER USING THE SAME

(71) Applicant: LG ELECTRONICS INC., Seoul (KR)

(72) Inventors: Dongsoo Choung, Seoul (KR); Guntae Bae, Seoul (KR)

(73) Assignee: LG Electronics Inc., Seoul (KR)

( * ) Notice: Subject to any disclaimer, the term of this patent is extended or adjusted under 35 U.S.C. 154(b) by 160 days.

(21) Appl. No.: 16/588,312

(22) Filed: Sep. 30, 2019

(65) Prior Publication Data

US 2020/0024790 A1 Jan. 23, 2020

(30) Foreign Application Priority Data

Aug. 30, 2019 (KR) ..... 10-2019-0107797

(51) Int. Cl.

| | |
|---|---|
| ***D06F 37/24*** | (2006.01) |
| ***D06F 33/48*** | (2020.01) |
| ***D06F 23/04*** | (2006.01) |
| *D06F 103/24* | (2020.01) |
| *D06F 103/26* | (2020.01) |
| *D06F 105/46* | (2020.01) |
| *D06F 105/48* | (2020.01) |
| *D06F 33/40* | (2020.01) |

(52) U.S. Cl.

CPC ..... *D06F 33/48* (2020.02); *D06F 23/04* (2013.01); *D06F 37/245* (2013.01); *D06F 33/40* (2020.02); *D06F 2103/24* (2020.02); *D06F 2103/26* (2020.02); *D06F 2105/46* (2020.02); *D06F 2105/48* (2020.02)

(58) Field of Classification Search

CPC ..... D06F 33/48; D06F 33/40; D06F 23/04; D06F 37/245; D06F 2105/48; D06F 2105/46; D06F 2103/26; D06F 2103/24

USPC ..... 8/159

See application file for complete search history.

(56) References Cited

U.S. PATENT DOCUMENTS

2009/0183318 A1* 7/2009 Kim ..... D06F 37/225 8/159

FOREIGN PATENT DOCUMENTS

EP 3348694 B1 * 4/2020 ..... D06F 33/36

* cited by examiner

*Primary Examiner* — Tinsae B Ayalew

(74) *Attorney, Agent, or Firm* — Fish & Richardson P.C.

(57) ABSTRACT

A laundry dewatering method using an intelligent washing machine is disclosed. A laundry dewatering method using an intelligent washing machine trains a ball balancer control model for acquiring first ball balancer control information related to position control in an inner tub of a ball balancer positioned in the inner tub, acquires first washing machine state information related to a dewatering operation of the washing machine, acquires the first ball balancer control information by inputting the first washing machine state information to the trained ball balancer control model, controls a position of the ball balancer in the inner tub on the basis of the acquired first ball balancer control information, and dewaters the laundry on the basis of the control result, thereby being able to reduce vibration and noise of the washing machine due to laundry that is non-uniformly received and dewatered in the inner tub.

13 Claims, 11 Drawing Sheets

INTELLIGENT WASHING MACHINE AND METHOD FOR CONTROLLING BALL BALANCER USING THE SAME

CROSS-REFERENCE TO RELATED APPLICATION

This application claims the priority benefit of Korean Patent Application No. 10-2019-0107797, filed on Aug. 30, 2019, the contents of which are incorporated by reference herein in their entirety.

BACKGROUND OF THE INVENTION

Field of the Invention

The present disclosure relates to a laundry dewatering method and an apparatus therefor and, more particularly, to a laundry dewatering method using an intelligent washing machine, and an apparatus therefor.

Related Art

In general, a washing machine means various apparatuses that process fabrics by applying a physical action and/or a chemical action to laundry such as clothes and bedclothes. A washing machine includes an outer tub that receives washing water and an inner tub 211 that receives fabrics and is rotatably installed inside the outer tub. The washing method of common washing machines includes a washing process that washes fabrics by operating the inner tub and rotating the inner tub 211, a dewatering process that dewaters the fabrics using the centrifugal force of the inner tub 211, and a drying process that dries the fabrics by applying heat.

In the dewatering process, the fabrics 211 received in the inner tub 211 may be non-uniformly distributed, so vibration may be generated and noise may be generated by the generated vibration. Accordingly, there is a need for a plan that can prevent rotating unbalance of an inner tub by installing a ball balancer in the inner tub and appropriately controlling the position of the ball balancer in a dewatering process of fabrics.

SUMMARY OF THE INVENTION

An object of the present disclosure is to solve the necessities and/or problems described above.

Further, an object of the present disclosure is to implement a method of preventing rotating unbalance of an inner tub due to non-uniform distribution of wet laundry in the inner tub 211 of a washing machine.

Further, an object of the present disclosure is to implement a method of training a model for ball balancer position control by acquiring data obtained by sampling information related to the state of wet laundry and the operation of an inner tub of a washing machine.

A laundry dewatering method using an intelligent washing machine according to an embodiment of the present disclosure includes: training a ball balancer control model for acquiring first ball balancer control information related to position control in an inner tub of a ball balancer positioned in the inner tub; acquiring first washing machine state information related to a dewatering operation of the washing machine; acquiring the first ball balancer control information by inputting the first washing machine state information to the trained ball balancer control model; controlling a position of the ball balancer in the inner tub on the basis of the acquired first ball balancer control information; and dewatering the laundry on the basis of the control result.

The controlling of a position may be repeatedly performed in a motor rotation speed value period having a first motor rotation speed value as a start point and a second motor rotation speed value as an end point.

The method may further include, when a current motor rotation speed value of the washing machine reaches the second motor rotation speed value: acquiring and comparing a current vibration value of the washing machine with a predetermined critical vibration value; and changing the current motor rotation speed value on the basis of the comparing result.

The dewatering of the laundry may further include increasing the current motor rotation speed value to a maximum motor rotation speed value that a motor of the washing machine supports, when the current vibration value is smaller than the critical vibration value.

The dewatering of the laundry may further include decreasing the current motor rotation speed value of the washing machine to the first motor rotation speed value, when the current vibration value is larger than the critical vibration value.

The acquiring of first washing machine state information may further include: acquiring operation information related to an operation of a motor of the washing machine and position information related to relative positions of the laundry and the ball balancer; and acquiring the first washing machine state information by sampling at least one of the operation information or the position information.

The operation information may include at least one value of a current motor rotation speed value of the motor and a target motor rotation speed value.

The position information may further include at least one of unbalance (UB) mass, a motor inflow current value, and a 6-axial gyro/acceleration sensor value.

The training of a ball balancer control model may be repeatedly performed in a specific motor rotation speed value period having a first motor rotation speed value as a start point and a second motor rotation speed value as an end point, and may include: collecting a plurality of items of washing machine state information, which are data for training the ball balancer control model in the specific motor rotation speed value period, in the specific motor rotation speed value period; inputting the plurality of items of washing machine state information collected in the specific motor rotation speed value period into the ball balancer control model; controlling the ball balancer control model to set a certain motor rotation acceleration value as output for each of the plurality of items of input washing machine state information; and acquiring a ball balancer control information set that is information related to a specific motor rotation acceleration value for each of the plurality of items of washing machine state information, and the specific motor rotation acceleration value may be an acceleration value for making a vibration value of the washing machine satisfy a target vibration value when the motor rotation speed of the washing machine reaches a second specific motor rotation value.

The acquiring of a ball balancer control information set may include applying a reward to the ball balancer control model on the basis of whether the vibration value satisfies the target vibration value when the current moor rotation speed value of the washing machine reaches the second motor rotation speed value, in which the ball balancer control model to which the reward is applied may update the plurality of items of washing machine state information included in the ball balancer control information set and the specific motor rotation acceleration values respectively related to the plurality of items of washing machine state information on the basis of the reward.

The acquiring of first ball balancer control information may further include receiving DCI (Downlink Control Information), which is used for scheduling transmission of the first washing machine state information, from a network, in which the first washing machine state information may be transmitted to the network on the basis of the DCI.

The method may further include performing a procedure for initial connection with the network on the basis of an SSB (Synchronization signal block), in which the first washing machine state information may be transmitted to the network through a PUSCH (Physical Uplink Shared Channel), and DM-RSs (Dedicated demodulation Reference Signal) of the SSB and the PUSCH may have undergone QCK (Quasi-Co Location) for a QCL type D.

The method may further include: controlling a communication unit to transmit the first washing machine state information to an AI processor included in the network; and controlling the communication unit to receive AI-processed information from the AI processor, in which the AI-processed information may be the first ball balancer control information.

An intelligent washing machine according to anther aspect of the present disclosure includes: an inner tub in which laundry is received; a motor transmitting torque to the inner tub; a ball balancer positioned in the inner tub; a sensing unit; a communication unit; and a controller training the ball balancer control model for acquiring first ball balancer control information related to position control in the inner tub of a ball balancer positioned in the inner tub, acquiring first washing machine state information related to a dewatering operation of the washing machine, acquiring the first ball balancer control information by inputting the first washing machine state information to the trained ball balancer control model, controlling a position of the ball balancer in the inner tub on the basis of the acquired first ball balancer control information, and dewatering the laundry on the basis of the control result.

BRIEF DESCRIPTION OF THE DRAWINGS

Accompanying drawings included as a part of the detailed description for helping understand the present disclosure provide embodiments of the present disclosure and are provided to describe technical features of the present disclosure with the detailed description.

DESCRIPTION OF EXEMPLARY EMBODIMENTS

Hereinafter, embodiments of the disclosure will be described in detail with reference to the attached drawings. The same or similar components are given the same reference numbers and redundant description thereof is omitted. The suffixes "module" and "unit" of elements herein are used for convenience of description and thus can be used interchangeably and do not have any distinguishable meanings or functions. Further, in the following description, if a detailed description of known techniques associated with the present invention would unnecessarily obscure the gist of the present invention, detailed description thereof will be omitted. In addition, the attached drawings are provided for easy understanding of embodiments of the disclosure and do not limit technical spirits of the disclosure, and the embodiments should be construed as including all modifications, equivalents, and alternatives falling within the spirit and scope of the embodiments.

While terms, such as "first", "second", etc., may be used to describe various components, such components must not be limited by the above terms. The above terms are used only to distinguish one component from another.

When an element is "coupled" or "connected" to another element, it should be understood that a third element may be present between the two elements although the element may be directly coupled or connected to the other element. When an element is "directly coupled" or "directly connected" to another element, it should be understood that no element is present between the two elements.

The singular forms are intended to include the plural forms as well, unless the context clearly indicates otherwise.

In addition, in the specification, it will be further understood that the terms "comprise" and "include" specify the presence of stated features, integers, steps, operations, elements, components, and/or combinations thereof, but do not preclude the presence or addition of one or more other features, integers, steps, operations, elements, components, and/or combinations.

Hereinafter, 5G communication (5th generation mobile communication) required by an apparatus requiring AI processed information and/or an AI processor will be described through paragraphs A through G.

A. Example of Block Diagram of UE and 5G Network

Figure 1:
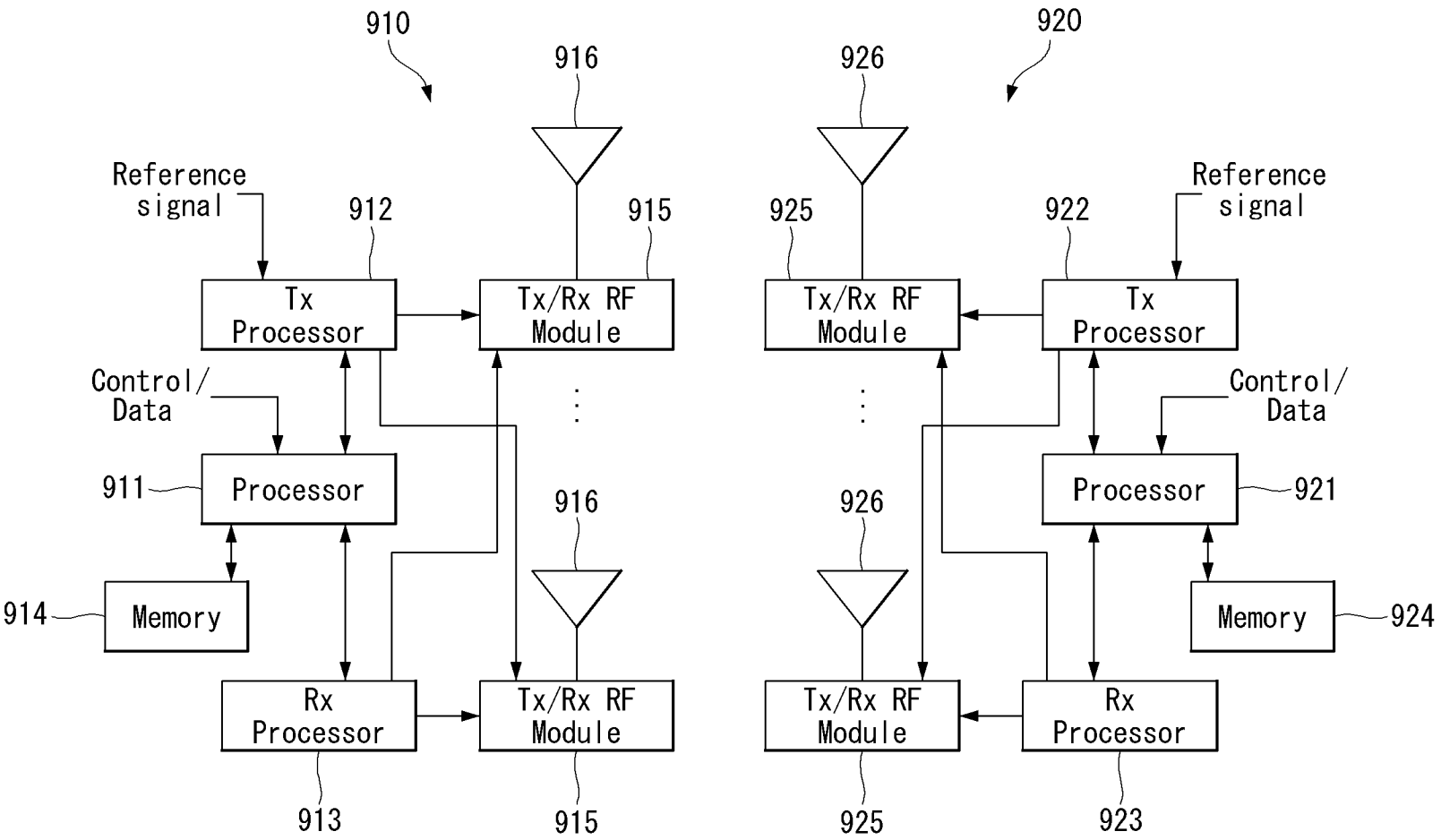
FIG. 1 is a block diagram illustrating a wireless communication system to which methods proposed herein may apply.

FIG. 1 is a block diagram of a wireless communication system to which methods proposed in the disclosure are applicable.

Referring to FIG. 1, a device (AI device) including an AI module is defined as a first communication device (910 of FIG. 1), and a processor 911 can perform detailed AI operation.

A 5G network including another device (AI server) communicating with the AI device is defined as a second communication device (920 of FIG. 1), and a processor 921 can perform detailed AI operations.

The 5G network may be represented as the first communication device and the AI device may be represented as the second communication device.

For example, the first communication device or the second communication device may be a base station, a network node, a transmission terminal, a reception terminal, a wireless device, a wireless communication device, an autonomous device, or the like.

For example, the first communication device or the second communication device may be a base station, a network node, a transmission terminal, a reception terminal, a wireless device, a wireless communication device, a vehicle, a vehicle having an autonomous function, a connected car, a drone (Unmanned Aerial Vehicle, UAV), and AI (Artificial Intelligence) module, a robot, an AR (Augmented Reality) device, a VR (Virtual Reality) device, an MR (Mixed Reality) device, a hologram device, a public safety device, an MTC device, an IoT device, a medical device, a Fin Tech device (or financial device), a security device, a climate/environment device, a device associated with 5G services, or other devices associated with the fourth industrial revolution field.

For example, a terminal or user equipment (UE) may include a cellular phone, a smart phone, a laptop computer, a digital broadcast terminal, personal digital assistants (PDAs), a portable multimedia player (PMP), a navigation device, a slate PC, a tablet PC, an ultrabook, a wearable device (e.g., a smartwatch, a smart glass and a head mounted display (HMD)), etc. For example, the HMD may be a display device worn on the head of a user. For example, the HMD may be used to realize VR, AR or MR. For example, the drone may be a flying object that flies by wireless control signals without a person therein. For example, the VR device may include a device that implements objects or backgrounds of a virtual world. For example, the AR device may include a device that connects and implements objects or background of a virtual world to objects, backgrounds, or the like of a real world. For example, the MR device may include a device that unites and implements objects or background of a virtual world to objects, backgrounds, or the like of a real world. For example, the hologram device may include a device that implements 360-degree 3D images by recording and playing 3D information using the interference phenomenon of light that is generated by two lasers meeting each other which is called holography. For example, the public safety device may include an image repeater or an imaging device that can be worn on the body of a user. For example, the MTC device and the IoT device may be devices that do not require direct interference or operation by a person. For example, the MTC device and the IoT device may include a smart meter, a bending machine, a thermometer, a smart bulb, a door lock, various sensors, or the like. For example, the medical device may be a device that is used to diagnose, treat, attenuate, remove, or prevent diseases. For example, the medical device may be a device that is used to diagnose, treat, attenuate, or correct injuries or disorders. For example, the medial device may be a device that is used to examine, replace, or change structures or functions. For example, the medical device may be a device that is used to control pregnancy. For example, the medical device may include a device for medical treatment, a device for operations, a device for (external) diagnose, a hearing aid, an operation device, or the like. For example, the security device may be a device that is installed to prevent a danger that is likely to occur and to keep safety. For example, the security device may be a camera, a CCTV, a recorder, a black box, or the like. For example, the Fin Tech device may be a device that can provide financial services such as mobile payment.

Referring to FIG. 1, the first communication device 910 and the second communication device 920 include processors 911 and 921, memories 914 and 924, one or more Tx/Rx radio frequency (RF) modules 915 and 925, Tx processors 912 and 922, Rx processors 913 and 923, and antennas 916 and 926. The Tx/Rx module is also referred to as a transceiver. Each Tx/Rx module 915 transmits a signal through each antenna 926. The processor implements the aforementioned functions, processes and/or methods. The processor 921 may be related to the memory 924 that stores program code and data. The memory may be referred to as a computer-readable medium. More specifically, the Tx processor 912 implements various signal processing functions with respect to L1 (i.e., physical layer) in DL (communication from the first communication device to the second communication device). The Rx processor implements various signal processing functions of L1 (i.e., physical layer).

UL (communication from the second communication device to the first communication device) is processed in the first communication device 910 in a way similar to that described in association with a receiver function in the second communication device 920. Each Tx/Rx module 925 receives a signal through each antenna 926. Each Tx/Rx module provides RF carriers and information to the Rx processor 923. The processor 921 may be related to the memory 924 that stores program code and data. The memory may be referred to as a computer-readable medium.

B. Signal Transmission/Reception Method in Wireless Communication System

Figure 2:
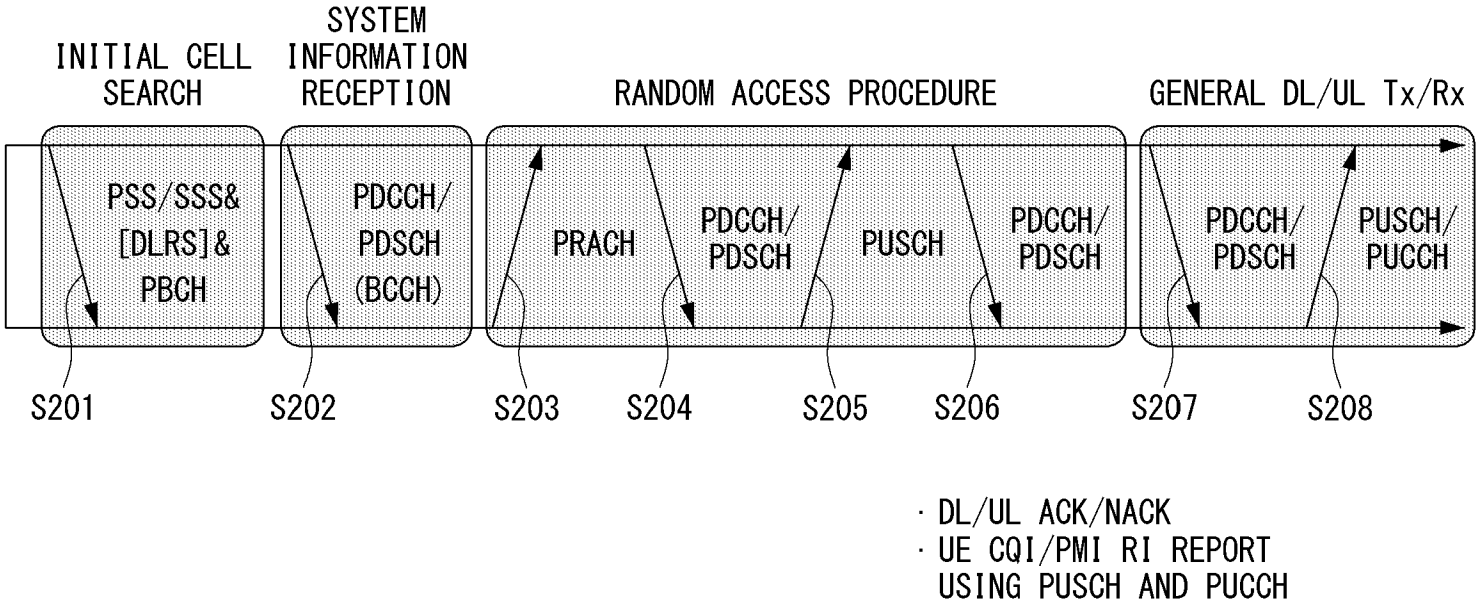
FIG. 2 is a view illustrating an example signal transmission/reception method in a wireless communication system.

FIG. 2 is a diagram showing an example of a signal transmission/reception method in a wireless communication system.

Referring to FIG. 2, when a UE is powered on or enters a new cell, the UE performs an initial cell search operation such as synchronization with a BS (S201). For this operation, the UE can receive a primary synchronization channel (P-SCH) and a secondary synchronization channel (S-SCH) from the BS to synchronize with the BS and acquire information such as a cell ID. In LTE and NR systems, the P-SCH and S-SCH are respectively called a primary synchronization signal (PSS) and a secondary synchronization signal (SSS). After initial cell search, the UE can acquire broadcast information in the cell by receiving a physical broadcast channel (PBCH) from the BS. Further, the UE can receive a downlink reference signal (DL RS) in the initial cell search step to check a downlink channel state. After initial cell search, the UE can acquire more detailed system information by receiving a physical downlink shared channel (PDSCH)

according to a physical downlink control channel (PDCCH) and information included in the PDCCH (S202).

Meanwhile, when the UE initially accesses the BS or has no radio resource for signal transmission, the UE can perform a random access procedure (RACH) for the BS (steps S203 to S206). To this end, the UE can transmit a specific sequence as a preamble through a physical random access channel (PRACH) (S203 and S205) and receive a random access response (RAR) message for the preamble through a PDCCH and a corresponding PDSCH (S204 and S206). In the case of a contention-based RACH, a contention resolution procedure may be additionally performed.

After the UE performs the above-described process, the UE can perform PDCCH/PDSCH reception (S207) and physical uplink shared channel (PUSCH)/physical uplink control channel (PUCCH) transmission (S208) as normal uplink/downlink signal transmission processes. Particularly, the UE receives downlink control information (DCI) through the PDCCH. The UE monitors a set of PDCCH candidates in monitoring occasions set for one or more control element sets (CORESET) on a serving cell according to corresponding search space configurations. A set of PDCCH candidates to be monitored by the UE is defined in terms of search space sets, and a search space set may be a common search space set or a UE-specific search space set. CORESET includes a set of (physical) resource blocks having a duration of one to three OFDM symbols. A network can configure the UE such that the UE has a plurality of CORESETs. The UE monitors PDCCH candidates in one or more search space sets. Here, monitoring means attempting decoding of PDCCH candidate(s) in a search space. When the UE has successfully decoded one of PDCCH candidates in a search space, the UE determines that a PDCCH has been detected from the PDCCH candidate and performs PDSCH reception or PUSCH transmission on the basis of DCI in the detected PDCCH. The PDCCH can be used to schedule DL transmissions over a PDSCH and UL transmissions over a PUSCH. Here, the DCI in the PDCCH includes downlink assignment (i.e., downlink grant (DL grant)) related to a physical downlink shared channel and including at least a modulation and coding format and resource allocation information, or an uplink grant (UL grant) related to a physical uplink shared channel and including a modulation and coding format and resource allocation information.

An initial access (IA) procedure in a 5G communication system will be additionally described with reference to FIG. 2.

The UE can perform cell search, system information acquisition, beam alignment for initial access, and DL measurement on the basis of an SSB. The SSB is interchangeably used with a synchronization signal/physical broadcast channel (SS/PBCH) block.

The SSB includes a PSS, an SSS and a PBCH. The SSB is configured in four consecutive OFDM symbols, and a PSS, a PBCH, an SSS/PBCH or a PBCH is transmitted for each OFDM symbol. Each of the PSS and the SSS includes one OFDM symbol and 127 subcarriers, and the PBCH includes 3 OFDM symbols and 576 subcarriers.

Cell search refers to a process in which a UE acquires time/frequency synchronization of a cell and detects a cell identifier (ID) (e.g., physical layer cell ID (PCI)) of the cell. The PSS is used to detect a cell ID in a cell ID group and the SSS is used to detect a cell ID group. The PBCH is used to detect an SSB (time) index and a half-frame.

There are 336 cell ID groups and there are 3 cell IDs per cell ID group. A total of 1008 cell IDs are present. Information on a cell ID group to which a cell ID of a cell belongs is provided/acquired through an SSS of the cell, and information on the cell ID among 336 cell ID groups is provided/acquired through a PSS.

The SSB is periodically transmitted in accordance with SSB periodicity. A default SSB periodicity assumed by a UE during initial cell search is defined as 20 ms. After cell access, the SSB periodicity can be set to one of {5 ms, 10 ms, 20 ms, 40 ms, 80 ms, 160 ms} by a network (e.g., a BS).

Next, acquisition of system information (SI) will be described.

SI is divided into a master information block (MIB) and a plurality of system information blocks (SIBs). SI other than the MIB may be referred to as remaining minimum system information. The MIB includes information/parameter for monitoring a PDCCH that schedules a PDSCH carrying SIB1 (SystemInformationBlock1) and is transmitted by a BS through a PBCH of an SSB. SIB1 includes information related to availability and scheduling (e.g., transmission periodicity and SI-window size) of the remaining SIBs (hereinafter, SIBx, x is an integer equal to or greater than 2). SiBx is included in an SI message and transmitted over a PDSCH. Each SI message is transmitted within a periodically generated time window (i.e., SI-window).

A random access (RA) procedure in a 5G communication system will be additionally described with reference to FIG. 2.

A random access procedure is used for various purposes. For example, the random access procedure can be used for network initial access, handover, and UE-triggered UL data transmission. A UE can acquire UL synchronization and UL transmission resources through the random access procedure. The random access procedure is classified into a contention-based random access procedure and a contention-free random access procedure. A detailed procedure for the contention-based random access procedure is as follows.

A UE can transmit a random access preamble through a PRACH as Msg1 of a random access procedure in UL. Random access preamble sequences having different two lengths are supported. A long sequence length 839 is applied to subcarrier spacings of 1.25 kHz and 5 kHz and a short sequence length 139 is applied to subcarrier spacings of 15 kHz, 30 kHz, 60 kHz and 120 kHz.

When a BS receives the random access preamble from the UE, the BS transmits a random access response (RAR) message (Msg2) to the UE. A PDCCH that schedules a PDSCH carrying a RAR is CRC masked by a random access (RA) radio network temporary identifier (RNTI) (RA-RNTI) and transmitted. Upon detection of the PDCCH masked by the RA-RNTI, the UE can receive a RAR from the PDSCH scheduled by DCI carried by the PDCCH. The UE checks whether the RAR includes random access response information with respect to the preamble transmitted by the UE, that is, Msg1. Presence or absence of random access information with respect to Msg1 transmitted by the UE can be determined according to presence or absence of a random access preamble ID with respect to the preamble transmitted by the UE. If there is no response to Msg1, the UE can retransmit the RACH preamble less than a predetermined number of times while performing power ramping. The UE calculates PRACH transmission power for preamble retransmission on the basis of most recent pathloss and a power ramping counter.

The UE can perform UL transmission through Msg3 of the random access procedure over a physical uplink shared channel on the basis of the random access response information. Msg3 can include an RRC connection request and a UE ID. The network can transmit Msg4 as a response to Msg3, and Msg4 can be handled as a contention resolution message on DL. The UE can enter an RRC connected state by receiving Msg4.

C. Beam Management (BM) Procedure of 5G Communication System

A BM procedure can be divided into (1) a DL MB procedure using an SSB or a CSI-RS and (2) a UL BM procedure using a sounding reference signal (SRS). In addition, each BM procedure can include Tx beam swiping for determining a Tx beam and Rx beam swiping for determining an Rx beam.

The DL BM procedure using an SSB will be described.

Configuration of a beam report using an SSB is performed when channel state information (CSI)/beam is configured in RRC_CONNECTED.

- A UE receives a CSI-ResourceConfig IE including CSI-SSB-ResourceSetList for SSB resources used for BM from a BS. The RRC parameter "csi-SSB-ResourceSetList" represents a list of SSB resources used for beam management and report in one resource set. Here, an SSB resource set can be set as {SSBx1, SSBx2, SSBx3, SSBx4, . . . }. An SSB index can be defined in the range of 0 to 63.
- The UE receives the signals on SSB resources from the BS on the basis of the CSI-SSB-ResourceSetList.
- When CSI-RS reportConfig with respect to a report on SSBRI and reference signal received power (RSRP) is set, the UE reports the best SSBRI and RSRP corresponding thereto to the BS. For example, when reportQuantity of the CSI-RS reportConfig IE is set to 'ssb-Index-RSRP', the UE reports the best SSBRI and RSRP corresponding thereto to the BS.

When a CSI-RS resource is configured in the same OFDM symbols as an SSB and 'QCL-TypeD' is applicable, the UE can assume that the CSI-RS and the SSB are quasi co-located (QCL) from the viewpoint of 'QCL-TypeD'. Here, QCL-TypeD may mean that antenna ports are quasi co-located from the viewpoint of a spatial Rx parameter. When the UE receives signals of a plurality of DL antenna ports in a QCL-TypeD relationship, the same Rx beam can be applied.

Next, a DL BM procedure using a CSI-RS will be described.

An Rx beam determination (or refinement) procedure of a UE and a Tx beam swiping procedure of a BS using a CSI-RS will be sequentially described. A repetition parameter is set to 'ON' in the Rx beam determination procedure of a UE and set to 'OFF' in the Tx beam swiping procedure of a BS.

First, the Rx beam determination procedure of a UE will be described.

- The UE receives an NZP CSI-RS resource set IE including an RRC parameter with respect to 'repetition' from a BS through RRC signaling. Here, the RRC parameter 'repetition' is set to 'ON'.
- The UE repeatedly receives signals on resources in a CSI-RS resource set in which the RRC parameter 'repetition' is set to 'ON' in different OFDM symbols through the same Tx beam (or DL spatial domain transmission filters) of the BS.
- The UE determines an RX beam thereof.
- The UE skips a CSI report. That is, the UE can skip a CSI report when the RRC parameter 'repetition' is set to 'ON'.

Next, the Tx beam determination procedure of a BS will be described.

- A UE receives an NZP CSI-RS resource set IE including an RRC parameter with respect to 'repetition' from the BS through RRC signaling. Here, the RRC parameter 'repetition' is related to the Tx beam swiping procedure of the BS when set to 'OFF'.
- The UE receives signals on resources in a CSI-RS resource set in which the RRC parameter 'repetition' is set to 'OFF' in different DL spatial domain transmission filters of the BS.
- The UE selects (or determines) a best beam.
- The UE reports an ID (e.g., CRI) of the selected beam and related quality information (e.g., RSRP) to the BS. That is, when a CSI-RS is transmitted for BM, the UE reports a CRI and RSRP with respect thereto to the BS.

Next, the UL BM procedure using an SRS will be described.

- A UE receives RRC signaling (e.g., SRS-Config IE) including a (RRC parameter) purpose parameter set to 'beam management" from a BS. The SRS-Config IE is used to set SRS transmission. The SRS-Config IE includes a list of SRS-Resources and a list of SRS-ResourceSets. Each SRS resource set refers to a set of SRS-resources.

The UE determines Tx beamforming for SRS resources to be transmitted on the basis of SRS-SpatialRelation Info included in the SRS-Config IE. Here, SRS-SpatialRelation Info is set for each SRS resource and indicates whether the same beamforming as that used for an SSB, a CSI-RS or an SRS will be applied for each SRS resource.

- When SRS-SpatialRelationInfo is set for SRS resources, the same beamforming as that used for the SSB, CSI-RS or SRS is applied. However, when SRS-SpatialRelationInfo is not set for SRS resources, the UE arbitrarily determines Tx beamforming and transmits an SRS through the determined Tx beamforming.

Next, a beam failure recovery (BFR) procedure will be described.

In a beamformed system, radio link failure (RLF) may frequently occur due to rotation, movement or beamforming blockage of a UE. Accordingly, NR supports BFR in order to prevent frequent occurrence of RLF. BFR is similar to a radio link failure recovery procedure and can be supported when a UE knows new candidate beams. For beam failure detection, a BS configures beam failure detection reference signals for a UE, and the UE declares beam failure when the number of beam failure indications from the physical layer of the UE reaches a threshold set through RRC signaling within a period set through RRC signaling of the BS. After beam failure detection, the UE triggers beam failure recovery by initiating a random access procedure in a PCell and performs beam failure recovery by selecting a suitable beam. (When the BS provides dedicated random access resources for certain beams, these are prioritized by the UE). Completion of the aforementioned random access procedure is regarded as completion of beam failure recovery.

D. URLLC (Ultra-Reliable and Low Latency Communication)

URLLC transmission defined in NR can refer to (1) a relatively low traffic size, (2) a relatively low arrival rate, (3) extremely low latency requirements (e.g., 0.5 and 1 ms), (4) relatively short transmission duration (e.g., 2 OFDM symbols), (5) urgent services/messages, etc. In the case of UL, transmission of traffic of a specific type (e.g., URLLC) needs to be multiplexed with another transmission (e.g., eMBB) scheduled in advance in order to satisfy more stringent latency requirements. In this regard, a method of providing information indicating preemption of specific resources to a UE scheduled in advance and allowing a URLLC UE to use the resources for UL transmission is provided.

NR supports dynamic resource sharing between eMBB and URLLC. eMBB and URLLC services can be scheduled on non-overlapping time/frequency resources, and URLLC transmission can occur in resources scheduled for ongoing eMBB traffic. An eMBB UE may not ascertain whether PDSCH transmission of the corresponding UE has been partially punctured and the UE may not decode a PDSCH due to corrupted coded bits. In view of this, NR provides a preemption indication. The preemption indication may also be referred to as an interrupted transmission indication.

With regard to the preemption indication, a UE receives DownlinkPreemption IE through RRC signaling from a BS. When the UE is provided with DownlinkPreemption IE, the UE is configured with INT-RNTI provided by a parameter int-RNTI in DownlinkPreemption IE for monitoring of a PDCCH that conveys DCI format 2_1. The UE is additionally configured with a corresponding set of positions for fields in DCI format 2_1 according to a set of serving cells and positionInDCI by INT-ConfigurationPerServing Cell including a set of serving cell indexes provided by servingCellID, configured having an information payload size for DCI format 2_1 according to dci-Payloadsize, and configured with indication granularity of time-frequency resources according to timeFrequencySect.

The UE receives DCI format 2_1 from the BS on the basis of the DownlinkPreemption IE.

When the UE detects DCI format 2_1 for a serving cell in a configured set of serving cells, the UE can assume that there is no transmission to the UE in PRBs and symbols indicated by the DCI format 2_1 in a set of PRBs and a set of symbols in a last monitoring period before a monitoring period to which the DCI format 2_1 belongs. For example, the UE assumes that a signal in a time-frequency resource indicated according to preemption is not DL transmission scheduled therefor and decodes data on the basis of signals received in the remaining resource region.

E. mMTC (Massive MTC)

mMTC (massive Machine Type Communication) is one of 5G scenarios for supporting a hyper-connection service providing simultaneous communication with a large number of UEs. In this environment, a UE intermittently performs communication with a very low speed and mobility. Accordingly, a main goal of mMTC is operating a UE for a long time at a low cost. With respect to mMTC, 3GPP deals with MTC and NB (NarrowBand)-IoT.

mMTC has features such as repetitive transmission of a PDCCH, a PUCCH, a PDSCH (physical downlink shared channel), a PUSCH, etc., frequency hopping, retuning, and a guard period.

That is, a PUSCH (or a PUCCH (particularly, a long PUCCH) or a PRACH) including specific information and a PDSCH (or a PDCCH) including a response to the specific information are repeatedly transmitted. Repetitive transmission is performed through frequency hopping, and for repetitive transmission, (RF) retuning from a first frequency resource to a second frequency resource is performed in a guard period and the specific information and the response to the specific information can be transmitted/received through a narrowband (e.g., 6 resource blocks (RBs) or 1 RB).

F. Basic Operation Between Autonomous Vehicles Using 5G Communication

Figure 3:
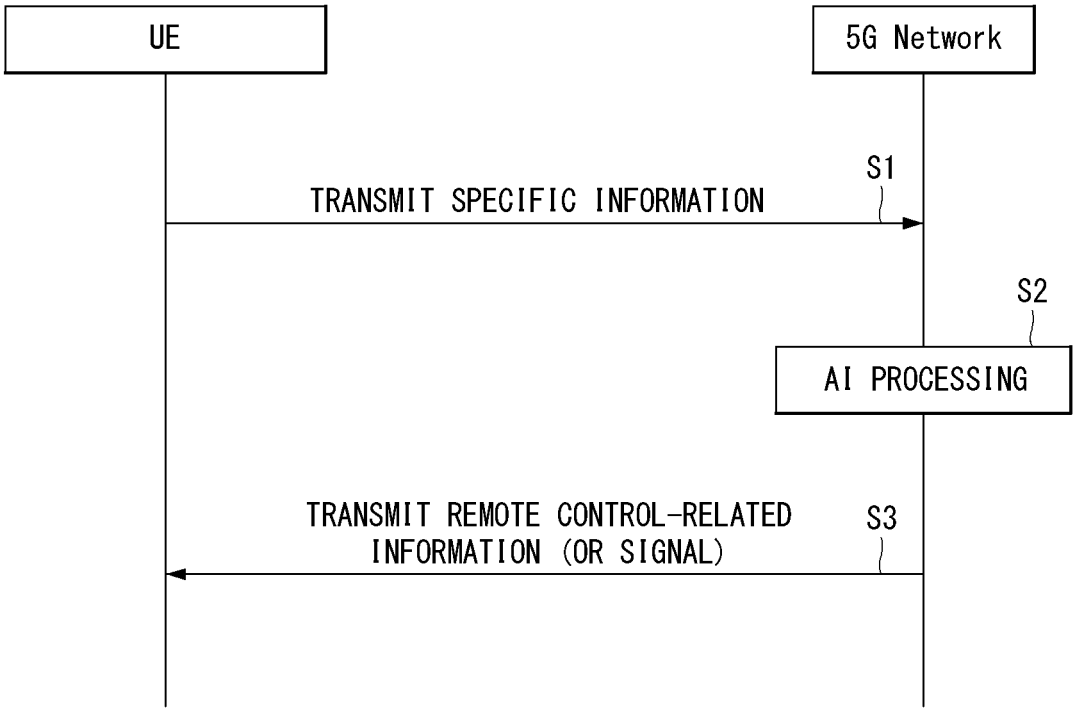
FIG. 3 is a view illustrating basic example operations of a user terminal and a 5G network in a 5G communication system.

FIG. 3 shows an example of basic operations of an autonomous vehicle and a 5G network in a 5G communication system.

The autonomous vehicle transmits specific information to the 5G network (S1). The specific information may include autonomous driving related information. In addition, the 5G network can determine whether to remotely control the vehicle (S2). Here, the 5G network may include a server or a module which performs remote control related to autonomous driving. In addition, the 5G network can transmit information (or signal) related to remote control to the autonomous vehicle (S3).

G. Applied Operations Between Autonomous Vehicle and 5G Network in 5G Communication System Hereinafter, the operation of an autonomous vehicle using 5G communication will be described in more detail with reference to wireless communication technology (BM procedure, URLLC, mMTC, etc.) described in FIGS. 1 and 2.

First, a basic procedure of an applied operation to which a method proposed by the present invention which will be described later and eMBB of 5G communication are applied will be described.

As in steps S1 and S3 of FIG. 3, the autonomous vehicle performs an initial access procedure and a random access procedure with the 5G network prior to step S1 of FIG. 3 in order to transmit/receive signals, information and the like to/from the 5G network.

More specifically, the autonomous vehicle performs an initial access procedure with the 5G network on the basis of an SSB in order to acquire DL synchronization and system information. A beam management (BM) procedure and a beam failure recovery procedure may be added in the initial access procedure, and quasi-co-location (QCL) relation may be added in a process in which the autonomous vehicle receives a signal from the 5G network.

In addition, the autonomous vehicle performs a random access procedure with the 5G network for UL synchronization acquisition and/or UL transmission. The 5G network can transmit, to the autonomous vehicle, a UL grant for scheduling transmission of specific information. Accordingly, the autonomous vehicle transmits the specific information to the 5G network on the basis of the UL grant. In addition, the 5G network transmits, to the autonomous vehicle, a DL grant for scheduling transmission of 5G processing results with respect to the specific information. Accordingly, the 5G network can transmit, to the autonomous vehicle, information (or a signal) related to remote control on the basis of the DL grant.

Next, a basic procedure of an applied operation to which a method proposed by the present invention which will be described later and URLLC of 5G communication are applied will be described.

As described above, an autonomous vehicle can receive DownlinkPreemption IE from the 5G network after the autonomous vehicle performs an initial access procedure and/or a random access procedure with the 5G network. Then, the autonomous vehicle receives DCI format 2_1 including a preemption indication from the 5G network on the basis of DownlinkPreemption IE. The autonomous vehicle does not perform (or expect or assume) reception of eMBB data in resources (PRBs and/or OFDM symbols) indicated by the preemption indication. Thereafter, when the autonomous vehicle needs to transmit specific information, the autonomous vehicle can receive a UL grant from the 5G network.

Next, a basic procedure of an applied operation to which a method proposed by the present invention which will be described later and mMTC of 5G communication are applied will be described.

Description will focus on parts in the steps of FIG. 3 which are changed according to application of mMTC.

In step S1 of FIG. 3, the autonomous vehicle receives a UL grant from the 5G network in order to transmit specific information to the 5G network. Here, the UL grant may include information on the number of repetitions of transmission of the specific information and the specific information may be repeatedly transmitted on the basis of the information on the number of repetitions. That is, the autonomous vehicle transmits the specific information to the 5G network on the basis of the UL grant. Repetitive transmission of the specific information may be performed through frequency hopping, the first transmission of the specific information may be performed in a first frequency resource, and the second transmission of the specific information may be performed in a second frequency resource. The specific information can be transmitted through a narrowband of 6 resource blocks (RBs) or 1 RB.

The above-described 5G communication technology can be combined with methods proposed in the present invention which will be described later and applied or can complement the methods proposed in the present invention to make technical features of the methods concrete and clear.

Laundry Dewatering Method Using Artificial Intelligence Device

The washing method of common washing machines includes a washing process that washes fabrics (laundry) by rotating an inner tub 211, a dewatering process that dewaters the fabrics using the centrifugal force of the inner tub 211, and a drying process that dries the fabrics by applying heat.

In the related art, in a laundry dewatering process, laundry received in the inner tub 211 is not uniformly distributed and is non-uniformly distributed in the inner tub 211, so rotating unbalance of the inner tub is caused and noise due to vibration of the washing machine is generated in the dewatering process. Further, even though laundry was uniformly distributed in the early stage of starting dewatering, the laundry may be non-uniformly distributed in the process in which water of the laundry is removed by dewatering.

Accordingly, the present disclosure provides a method of installing a ball balancer in the edge of an inner tub 211 of a washing machine and appropriately controlling the position of the ball balancer in order to prevent rotating unbalance of the inner tub 211 in a laundry dewatering process. In more detail, the present disclosure provides a method of reducing vibration and noise that are generated in a laundry dewatering process by training a ball balancer control model using artificial intelligence and by controlling the position of the ball balancer using the trained ball balancer control model.

Figure 4:
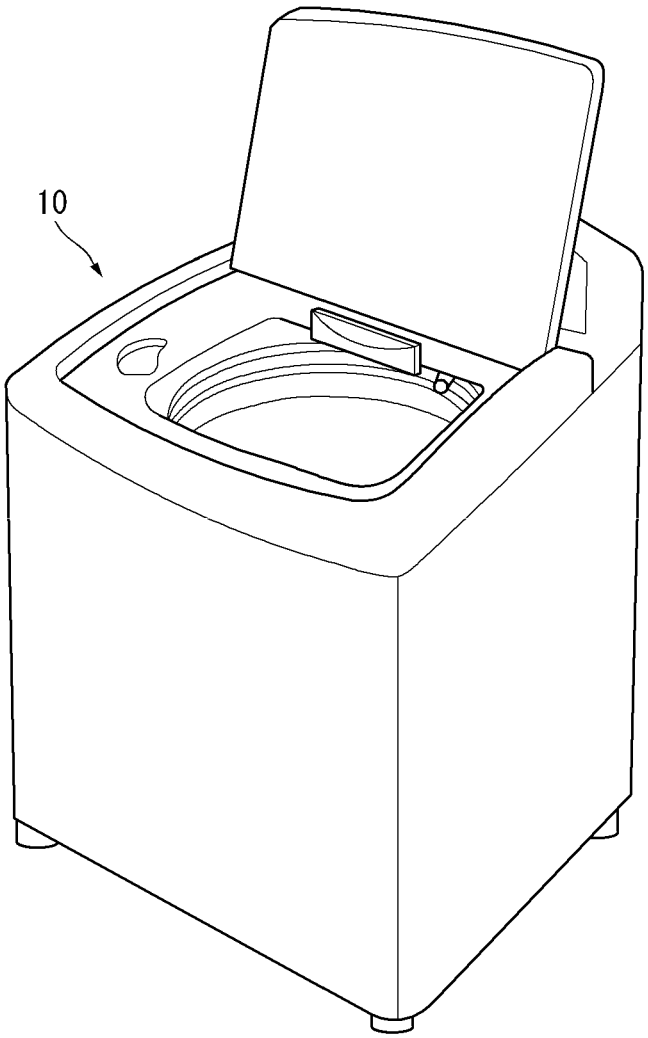
FIGS. 4 and 5 are diagrams showing an intelligent washing machine according to an embodiment of the present disclosure.
Figure 5:
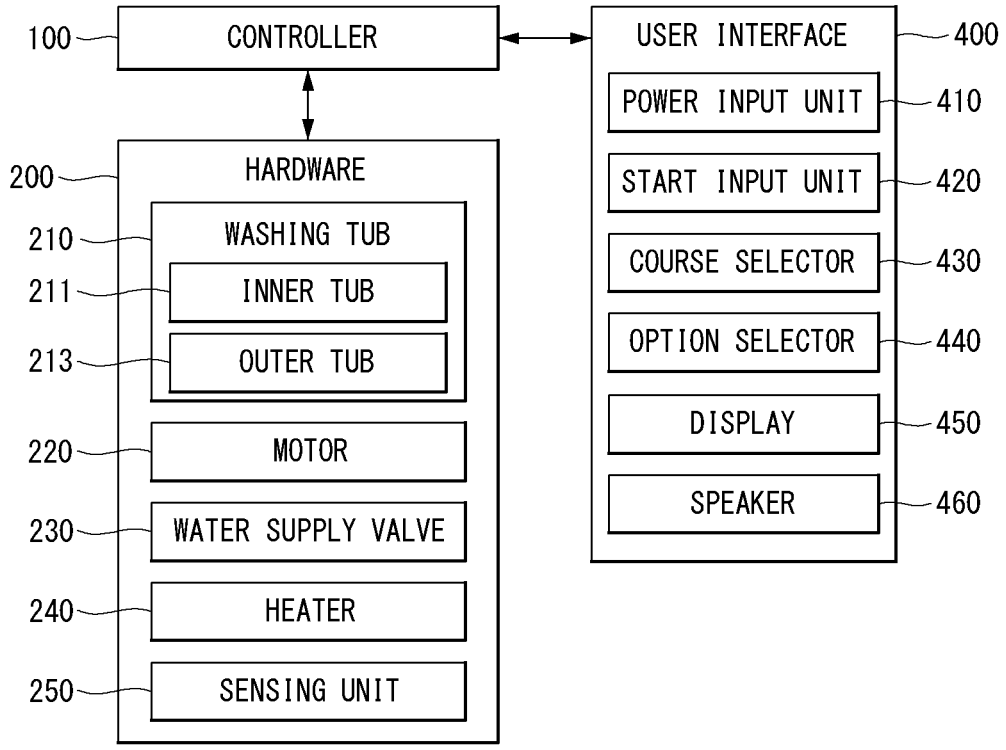

FIG. 4 is a diagram showing an intelligent washing machine according to an embodiment of the present disclosure. FIG. 5 is a block diagram showing the main configuration of the washing machine shown in FIG. 4.

Referring to FIGS. 4 and 5, a washing machine 10 according to an embodiment of the present disclosure includes a controller 100, a hardware unit 200, and a user interface 400.

The controller 100 controls the entire driving of the washing machine 10 by controlling the hardware unit 200 in accordance with input that is input through the user interface 400. Further, the controller 100 acquires washing machine state information related to a dewatering operation of the washing machine through a sensing unit 250 included in the hardware unit 200. The washing machine state information may be data obtained by sampling information related to the operation of the washing machine and position information related to relative positions of laundry and the ball balancer.

tion of a motor of the washing machine and pof the ball balancer by inputting the washing machine state information to the ball balancer control model.

The hardware 200 may include a washing tub 210, a motor 220, a water supply valve 230, a heater 240, a sensing unit 250, etc.

The washing tub 210 includes an outer tub 213 that accommodates washing water and an inner tub 211 that is disposed inside the outer tube 213, receives laundry, and rotates using torque provided from the motor 220. The water supply valve 230 controls supply of washing water. The heater 240 heats the water supplied in the inner tub. The sensing unit 250 senses the dry state of laundry received in the inner tub 211.

The user interface 400 may include a power input unit 410, a start input unit 420, a course selector 430, an option selector 440, a display 450, and a speaker 460.

The power input unit 410 provides a device for controlling on/off of a main power of the washing machine. The start input unit 420 provides a device for controlling start of a washing process, a rinsing process, or a dewatering process. The course selector 430 provides a device that can select the kinds of the washing process, the rinsing process, or the dewatering process. The option selector 440 provides a device that can select detailed options for performing the washing process, the rinsing process, or the dewatering process. For example, the option selector 440 may be a device for selecting water temperature, time, schedule, etc. The display 450 can display the operation state of the washing machine 10 or can display course information selected through the course selector 430 by a user, option information selected through the option selector 440, or time required to completely dry laundry. The speaker 460 outputs the operation state of the washing machine or a situation corresponding to a specific event using a voice signal. The specific event may be a situation such as fabric distribution control or RPM control based on a fabric image.

Figure 6:
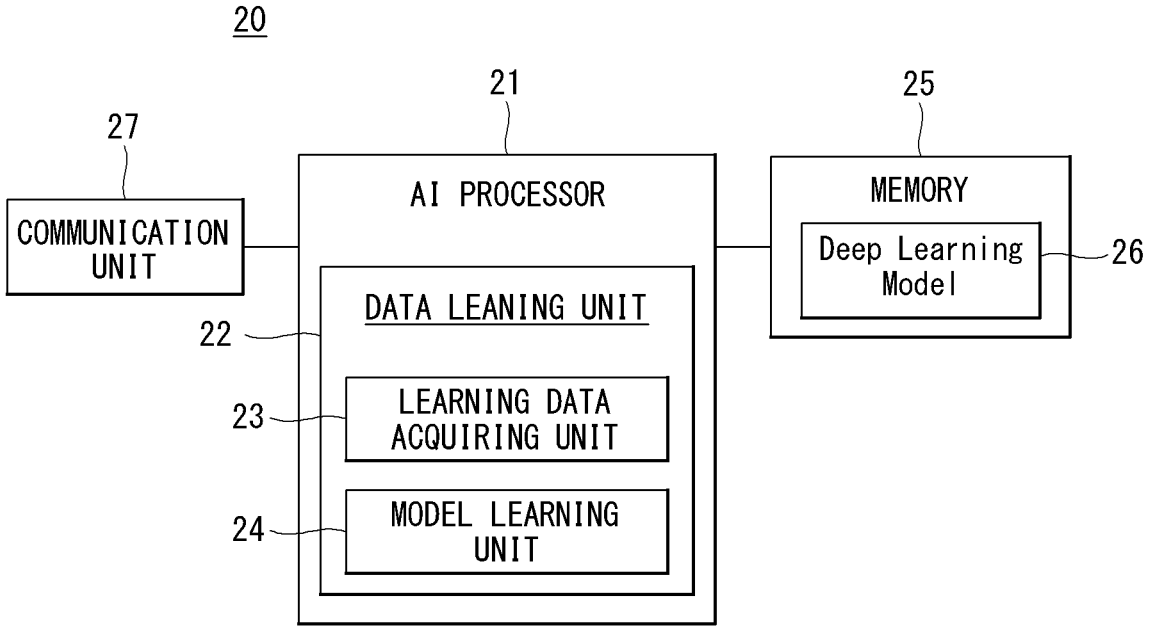
FIG. 6 is a block diagram illustrating an AI device according to an embodiment of the present invention.

FIG. 6 is a block diagram of an AI device according to an embodiment of the present disclosure.

Referring to FIG. 6, an AI device 20 may include an electronic device including an AI module that can perform AI processing, a server including the AI module, or the like. Further, the AI device 20 may be included as at least one component of the washing machine 10 shown in FIGS. 4 and 5 to perform together at least a portion of the AI processing.

The AI processing may include all operations related to the controller 100 of the washing machine 10 shown in FIG. 4. For example, the washing machine 10 can perform processing/determination and a control signal generation operation by performing AI processing on a laundry image, or fabric classification information, or fabric distribution information.

The AI device 20 may be a client device that directly uses an AI processing result or a device in a cloud environment that provides an AI processing result to another device. The AI device 20, which is a computing device that can train a neural network, may be implemented as various electronic devices such as a server, a desktop PC, a notebook PC, and a tablet PC.

The AI device 20 may include an AI processor 21, a memory 25, and/or a communication unit 27.

The AI processor 21 can train a neural network using programs stored in the memory 25. In particular, the AI processor 21 can train a neural network for recognizing data related to the washing machine. Here, the neural network for recognizing data related to the washing machine may be designed to simulate the brain structure of human on a computer and may include a plurality of network nodes having weights and simulating the neurons of human neural network. The plurality of network nodes can transmit and receive data in accordance with each connection relationship to simulate the synaptic activity of neurons in which neurons transmit and receive signals through synapses. Here, the neural network may include a deep learning model developed from a neural network model. In the deep learning model, a plurality of network nodes is positioned in different layers and can transmit and receive data in accordance with a convolution connection relationship. The neural network, for example, includes various deep learning techniques such as deep neural networks (DNN), convolutional deep neural networks (CNN), recurrent neural networks (RNN), a restricted boltzmann machine (RBM), deep belief networks (DBN), and a deep Q-network, and can be applied to fields such as computer vision, voice recognition, natural language processing, and voice/signal processing.

Meanwhile, a processor that performs the functions described above may be a general purpose processor (e.g., a CPU), but may be an AI-only processor (e.g., a GPU) for artificial intelligence learning.

The memory 25 can store various programs and data for the operation of the AI device 20. The memory 25 may be a nonvolatile memory, a volatile memory, a flash-memory, a hard disk drive (HDD), a solid state drive (SDD), or the like. The memory 25 is accessed by the AI processor 21 and reading-out/recording/correcting/deleting/updating, etc. of data by the AI processor 21 can be performed. Further, the memory 25 can store a neural network model (e.g., a deep learning model 26) generated through a learning algorithm for data classification/recognition according to an embodiment of the present invention.

Meanwhile, the AI processor 21 may include a data learning unit 22 that learns a neural network for data classification/recognition. The data learning unit 22 can learn references about what learning data are used and how to classify and recognize data using the learning data in order to determine data classification/recognition. The data learning unit 22 can learn a deep learning model by acquiring learning data to be used for learning and by applying the acquired learning data to the deep learning model.

The data learning unit 22 may be manufactured in the type of at least one hardware chip and mounted on the AI device 20. For example, the data learning unit 22 may be manufactured in a hardware chip type only for artificial intelligence, and may be manufactured as a part of a general purpose processor (CPU) or a graphics processing unit (GPU) and mounted on the AI device 20. Further, the data learning unit 22 may be implemented as a software module. When the data leaning unit 22 is implemented as a software module (or a program module including instructions), the software module may be stored in non-transitory computer readable media that can be read through a computer. In this case, at least one software module may be provided by an OS (operating system) or may be provided by an application.

The data learning unit 22 may include a learning data acquiring unit 23 and a model learning unit 24.

The learning data acquiring unit 23 can acquire learning data required for a neural network model for classifying and recognizing data. For example, the learning data acquiring unit 23 can acquire, as learning data, vehicle data and/or sample data to be input to a neural network model.

The model learning unit 24 can perform learning such that a neural network model has a determination reference about how to classify predetermined data, using the acquired learning data. In this case, the model learning unit 24 can train a neural network model through supervised learning that uses at least some of learning data as a determination reference. Alternatively, the model learning data 24 can train a neural network model through unsupervised learning that finds out a determination reference by performing learning by itself using learning data without supervision. Further, the model learning unit 24 can train a neural network model through reinforcement learning using feedback about whether the result of situation determination according to learning is correct. Further, the model learning unit 24 can train a neural network model using a learning algorithm including error back-propagation or gradient decent.

When a neural network model is learned, the model learning unit 24 can store the learned neural network model in the memory. The model learning unit 24 may store the learned neural network model in the memory of a server connected with the AI device 20 through a wire or wireless network.

The data learning unit 22 may further include a learning data preprocessor (not shown) and a learning data selector (not shown) to improve the analysis result of a recognition model or reduce resources or time for generating a recognition model.

The learning data preprocessor can preprocess acquired data such that the acquired data can be used in learning for situation determination. For example, the learning data preprocessor can process acquired data in a predetermined format such that the model learning unit 24 can use learning data acquired for learning for image recognition.

Further, the learning data selector can select data for learning from the learning data acquired by the learning data acquiring unit 23 or the learning data preprocessed by the preprocessor. The selected learning data can be provided to the model learning unit 24. For example, the learning data selector can select only data for objects included in a specific area as learning data by detecting the specific area in an image acquired through a camera of a vehicle.

Further, the data learning unit 22 may further include a model estimator (not shown) to improve the analysis result of a neural network model.

The model estimator inputs estimation data to a neural network model, and when an analysis result output from the estimation data does not satisfy a predetermined reference, it can make the model learning unit 22 perform learning again. In this case, the estimation data may be data defined in advance for estimating a recognition model. For example, when the number or ratio of estimation data with an incorrect analysis result of the analysis result of a recognition model learned with respect to estimation data exceeds a predetermined threshold, the model estimator can estimate that a predetermined reference is not satisfied.

The communication unit 27 can transmit the AI processing result by the AI processor 21 to an external electronic device.

Here, the external electronic device may be defined as an autonomous vehicle. Further, the AI device 20 may be defined as another vehicle or a 5G network that communicates with the autonomous vehicle. Meanwhile, the AI device 20 may be implemented by being functionally embedded in an autonomous module included in a vehicle. Further, the 5G network may include a server or a module that performs control related to autonomous driving.

Meanwhile, the AI device 20 shown in FIG. 6 was functionally separately described into the AI processor 21, the memory 25, the communication unit 27, etc., but it should be noted that the aforementioned components may be integrated in one module and referred to as an AI module.

Figure 7A:
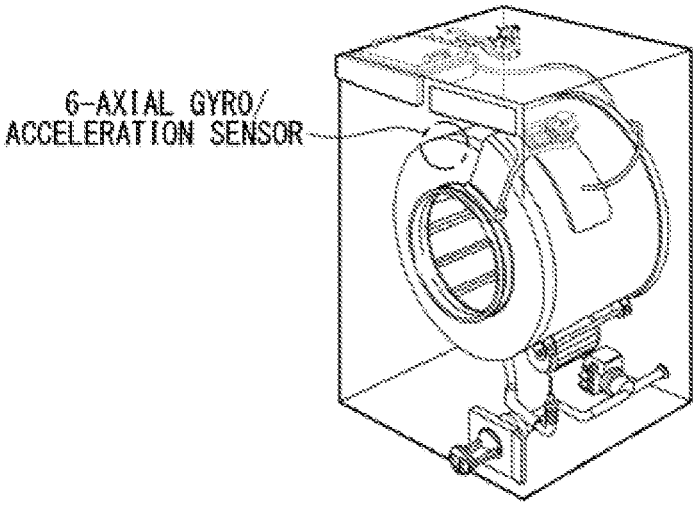
FIGS. 7A and 7B are diagrams showing an embodiment of the position and the operation of a ball balancer for balancing rotation of an inner tub according to an embodiment of the present disclosure.
Figure 7B:
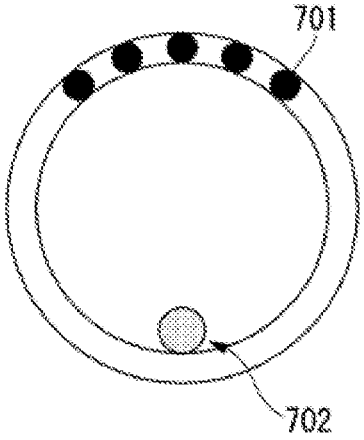

FIGS. 7A and 7B are diagrams showing an embodiment of the position and the operation of a ball balancer for balancing rotation of an inner tub according to an embodiment of the present disclosure.

FIG. 7A is a diagram showing positions on the edge of an inner tub 11 having a ball balancer.

The ball balancer is positioned in the edge of the inner tub and is designed to be able to freely move in a ring-shaped tube. There is no device that senses movement of the ball balancer or directly controls the ball balancer in the edge of the inner tub, and when the inner tub is rotated, the ball balancer can rotate in the tube by friction or inertia. The ball balancer may exist at various positions on the edge of the inner tub. For example, as shown in FIG. 7A, it may by positioned at the front surface, the middle, and the rear surface of the inner tub such as B1, B2, and B3.

FIG. 7B is an example for describing the principle of solving rotating unbalance of an inner tub using a ball balancer.

As shown in FIG. 7B, laundry existing in the inner tub forms unbalance (UB) mass, so the laundry may gather together at one position in the inner tub 211 without being uniformly distributed. In this case, when the inner tub 211 is rotated to dewater the laundry, washing water flows into one position in the inner tube 211, so rotating unbalance of the inner tub 211 is generated. Accordingly, in order to solve the rotating unbalance of the inner tub 211, it is required to move the ball balancer to an appropriate position in the edge of the inner tub by controlling the ball balancer. In more detail, the ball balancer may be positioned right opposite (at 180 degrees from) the laundry forming the unbalance mass. An object of the present disclosure is to move the ball balancer to an appropriate position in the edge of the inner tub 211, using an artificial intelligence device, when unbalance of laundry is generated in the inner tub 211, as described above.

Figure 8:
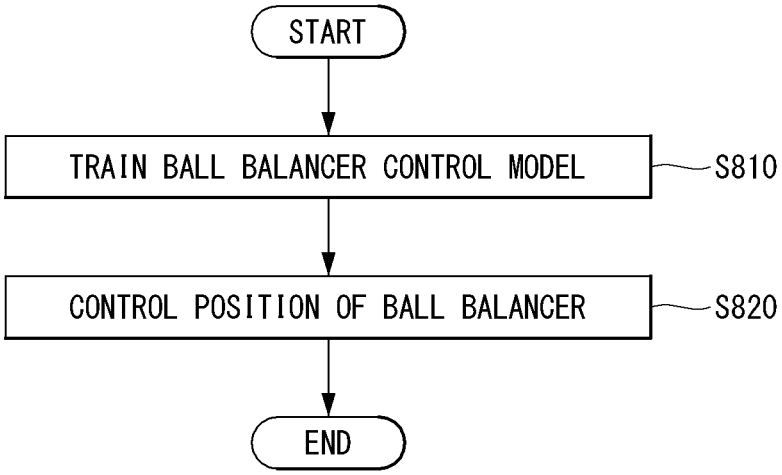
FIG. 8 is a flowchart showing an example of performing a laundry dewatering method using an artificial intelligence device according to an embodiment of the present disclosure.

FIG. 8 is a flowchart showing an example of performing a laundry dewatering method using an artificial intelligence device according to an embodiment of the present disclosure.

FIG. 8 is a diagram schematically showing the operation of a laundry dewatering method using an intelligent washing machine provided by the present disclosure.

The controller 100 trains the ball balancer control model for controlling the position of the ball balancer positioned in the edge of the inner tub 211 (S810).

The controller 100 controls the position of the ball balancer using the ball balancer model (S820).

Steps S810 to S820 described above are described in more detail hereafter.

Figure 9:
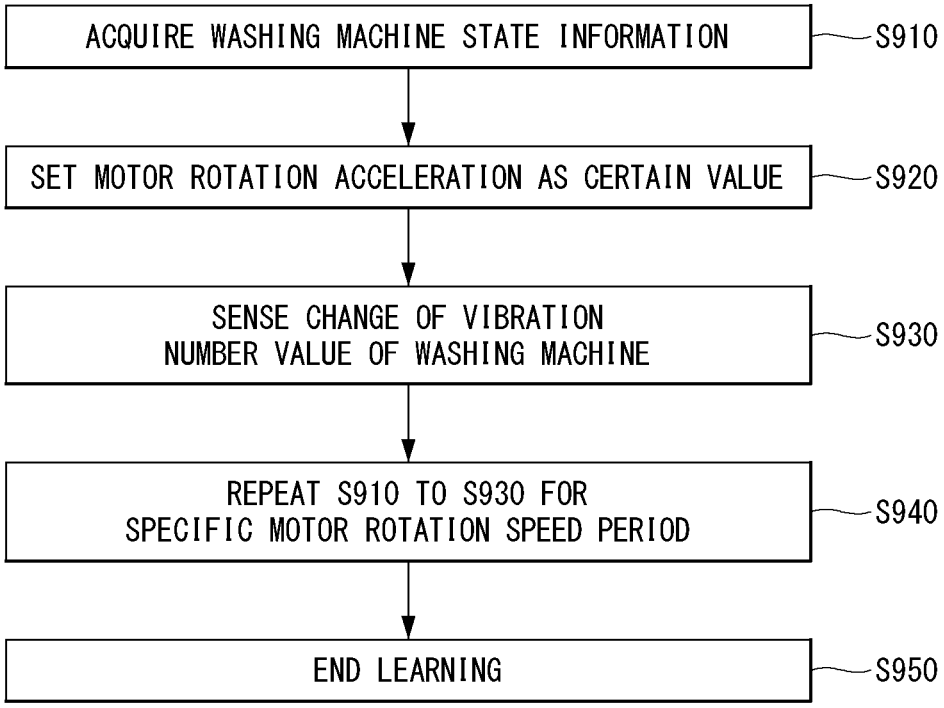
FIG. 9 is a flowchart showing an example of performing a laundry dewatering method using an intelligent washing machine according to an embodiment of the present disclosure.

FIG. 9 is a flowchart showing an example of performing a laundry dewatering method using an intelligent washing machine according to an embodiment of the present disclosure.

FIG. 9 shows in detail step in which the controller 100 trains the ball balancer control model.

The ball balancer control model is trained through a reinforcement learning algorithm. Reinforcement learning is performed in a way in which a model (agent) received a state, takes a random action of actions that the model can take for the input state, and receives a reward in accordance with the result of the action. The reward is given to an action that was the base of result. For example, when there are two actions of an action 1 and an action 2 that a model can take for a specific state, if the result of performing the action 1 is better, a reward can be given to the action 1.

By repeating the process of taking a random action in a specific state and is given a corresponding reward, the model can take an optimal action that is given the largest positive (+) reward of actions that the model can take for each of states. Consequently, the reinforcement learning is finished. Here, the fact that a model is trained to be able to make optimal selection for each state may be understood as establishing a 'policy' that is the reference of making optimal selection for each state.

Returning to FIG. 9, the controller 100 acquires washing machine state information related to the dewatering operation of the washing machine sensed by the sensing unit 250 from the sensing unit 250 disposed in the intelligent washing machine 10. The washing machine state information is information obtained by sampling at a predetermined period at least one of a target (requested) motor rotation speed of the inner tub 212 in the washing machine, the current motor rotation speed, unbalance (UB) mass, motor inflow current (IQ), a 6-axial gyro/acceleration sensor value, and four forward/rearward phase difference values.

The controller inputs the washing machine state information to the ball balancer control model and the ball balancer control model sets a motor rotation speed acceleration (or angular acceleration) as a certain value to control the position of the ball balancer (S920). The motor rotation speed acceleration means a motor rotation speed variation of the inner tub 211 of the washing machine 10 per unit time. Further, the washing machine state information corresponds to the state that the reinforcement learning model receives.

Since the controller 100 sets the motor rotation speed acceleration as a certain value, the rotating unbalance of the inner tub 211 is changed, and accordingly, the vibration value of the inner tub 211 can become larger or smaller than before the rotation acceleration change per minute. The controller 100 senses a changed vibration value through the sensing unit 250, and can give a (−) reward to the set rotation number acceleration value if the vibration value became larger than before the motor rotation speed acceleration is set. In contrast, if the vibration value became smaller than before the motor rotation speed acceleration is set, it is possible to give a (+) reward to the set rotation number acceleration value.

The controller 100 repeatedly performs steps S910 to S930 in a specific motor rotation speed period (S930). That is, the controller 100 repeats the process of inputting washing machine state information of various states to the ball balancer control model, of setting the motor rotation speed acceleration as various certain values in accordance with various inputs by means of the ball balancer control model, and of applying a reward in accordance with the result of setting a certain motor rotation speed acceleration value. As the result of repeating, the ball balancer control model can be trained to take an optimal action for a specific state. That is, an optimal rotation acceleration value per minute can be determined for specific washing machine state information.

The controller 100 ends training when what optimal actions the ball balancer control model is trained to take for all states (S840). The ball balancer control model that has finished being trained, as the result of training, can store items of information about optimal selections for various states such as (state 1↔5 rpm acceleration), (state 2↔10 rpm acceleration) . . . (state n↔20 rpm acceleration).

Figure 10:
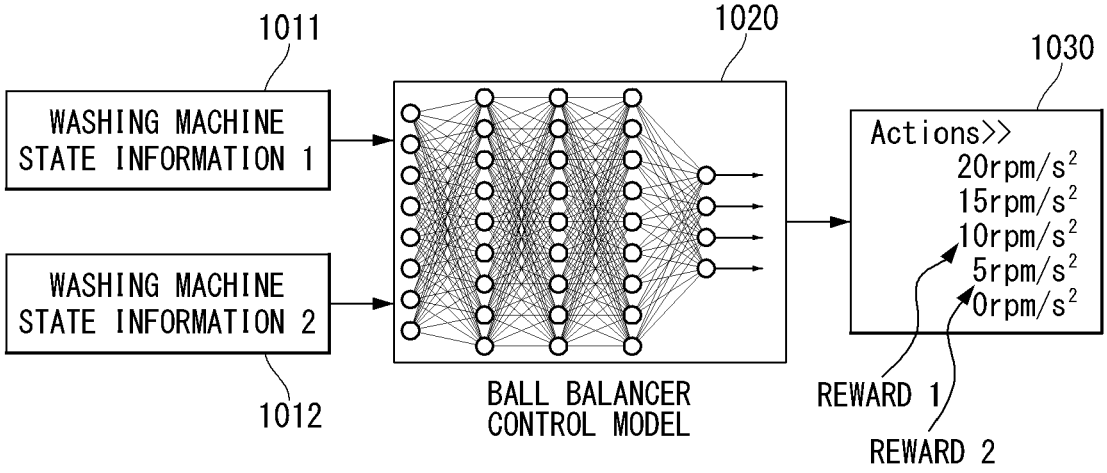
FIG. 10 is a diagram showing an example of performing a laundry dewatering method using an intelligent washing machine according to an embodiment of the present disclosure.

FIG. 10 is a diagram showing an example of performing a laundry dewatering method using an intelligent washing machine according to an embodiment of the present disclosure.

Washing machine state information 1 (1011) is input to a ball balancer control model 1020. The ball balancer control model sets one certain motor rotation speed acceleration value of candidate motor rotation speed acceleration values that can be set. For the convenience of description, it is assumed that there are five candidate motor rotation speed acceleration values (0, 5, 10, 15, and 20 rpm/s^2). The ball balancer control model receives the washing machine state information 1 and randomly sets a motor rotation speed acceleration value, 10 rpm/s^2. A (+) or (−) reward can be given to 10 rpm/s^2 on the basis of the result of setting the motor rotation speed acceleration value as 10 rpm/s^2.

In the earl stage of training, the ball balancer control model cannot know which motor rotation speed acceleration value it takes is the optimal action for the washing machine state information 1, but it can find out which value is the optimal motor rotation speed acceleration value by repeatedly taking certain motor rotation speed acceleration values for the washing machine state information 1.

The ball balancer control model can be trained to find out what is the optimal motor rotation speed acceleration value when receiving the washing machine state information 2 as input, by repeating the above operation for the washing machine state information 2.

Figure 11:
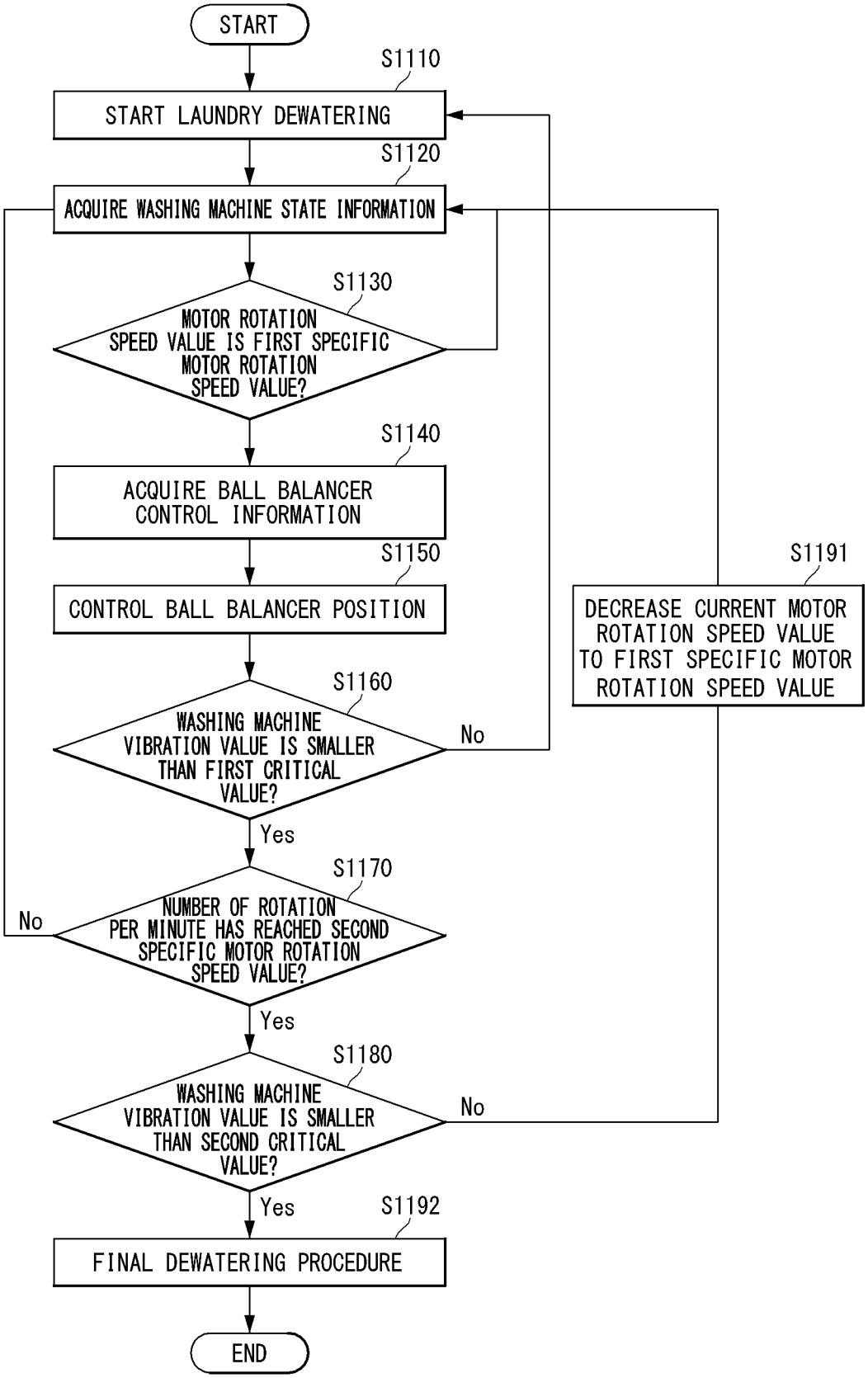
FIG. 11 is a flowchart showing an example of performing a laundry dewatering method using an intelligent washing machine according to an embodiment of the present disclosure.

FIG. 11 is a flowchart showing an example of performing a laundry dewatering method using an intelligent washing machine according to an embodiment of the present disclosure.

FIG. 11 shows in detail a step in which the controller 100 controls the position of the ball balancer using the trained ball balancer control model.

The controller 100 starts laundry dewatering (S1110). The controller 100 that has started laundry dewatering senses operation information related to the operation state of the washing machine and position information related to the relative positions of the laundry and the ball balancer through the sensing unit 250. Further, the controller 100 acquires washing machine state information by sampling the operation information and the position information at every predetermined period (S1120). The operation information may include a target (requested) motor rotation speed and a current motor rotation speed, and the position information may include unbalance (UB) mass, a motor inflow current (IQ), a 6-axial sensor value, and fourth forward/rearward phase difference.

Next, the controller 100 determines whether the current motor rotation information is a first specific motor rotation value or more (S1130). When it is determined that the current motor rotation information less than first specific motor rotation value, step S1120 is performed.

When it is determined that the current motor rotation information is a first specific motor rotation value or more, the controller 100 inputs the washing machine state information to the ball balancer control model trained in advance, and the ball balancer control model acquires ball balancer control information on the basis of trained data (S1140). The ball balancer control information may be an angular acceleration value for controlling the position of the ball balancer existing in the edge of the inner tub 211. In more detail, the ball balancer control model that has finished being trained may know the optimal angular acceleration value for each of specific states. That is, for each of specific states, the ball balancer control model may have the optimal angular acceleration value for moving the position of the ball balancer to an ideal position in the specific states.

The controller 100 that has acquired the ball balancer control information controls the position of the ball balancer on the basis of the ball balancer control information (S1150). The controller 100, in order to control the position of the ball balancer, can set the current angular acceleration value of the inner tub 211 as the angular acceleration value included in the ball balancer control information.

The controller 100 that has controlled the position of the ball balancer on the basis of the ball balancer control information determines whether the current vibration value of the washing machine 10 is smaller than a predetermined first critical value after position control of the ball balancer (S1160). If the current vibration value of the washing machine 10 is larger than the predetermined first critical value, the controller 100 determines that it is a case in which it is difficult to balance the rotation of the inner tub by controlling the position of the ball balancer, and returns to step S1110. In this case, the controller 100 can set the motor rotation speed of the inner tub 211 as 0 rpm.

On the contrary, when the current vibration value of the washing machine 10 is smaller than the predetermined first critical value, the controller 100 determines whether the current motor rotation speed of the inner tub 211 has reached a second specific motor rotation speed value (S1170). As the result of determining whether the current motor rotation speed of the inner tub 211 has reached the second specific motor rotation speed value, when the current motor rotation speed is smaller than the second specific motor rotation speed value, the controller returns to step S1120 and repeatedly performs steps S1120 to S1160. On the contrary, As the result of determining whether the current motor rotation speed of the inner tub 211 has reached the second specific motor rotation speed value, when the current motor rotation speed has reached the second specific motor rotation speed value, the controller 100 determines whether the current vibration value of the washing machine 100 is smaller than a predetermined second critical value (S1180).

As the result of determining whether the current vibration value of the washing machine 100 is smaller than the predetermined second critical value, when the current vibration value of the washing machine 100 is larger than the predetermined second critical value, the controller 100 decreases the current motor rotation value to a first specific rotation number value (S1191). After the current motor rotation value is decreased to the first specific rotation number value, the controller 100 repeats steps S1120 to S1170. That is, the controller 100 performs position control of the ball balancer using the ball balancer control model in a specific motor rotation speed period having the first specific motor rotation speed value as a start point and the second specific motor rotation speed value as an end point. The first motor rotation speed value may be 108 rpm and the second motor rotation speed value may be 350 rpm.

Returning to S1180, as the result of determining whether the current vibration value of the washing machine 10 is smaller than the predetermined second critical value, when the current vibration value of the washing machine 10 is smaller than the predetermined second critical value, the controller 100 performs a final rinsing procedure (S1192). The final rinsing procedure means a procedure of finishing dewatering by increasing the current motor rotation speed to the maximum motor rotation speed in the inner tub 211 that the washing machine 10 supports.

Figure 12:
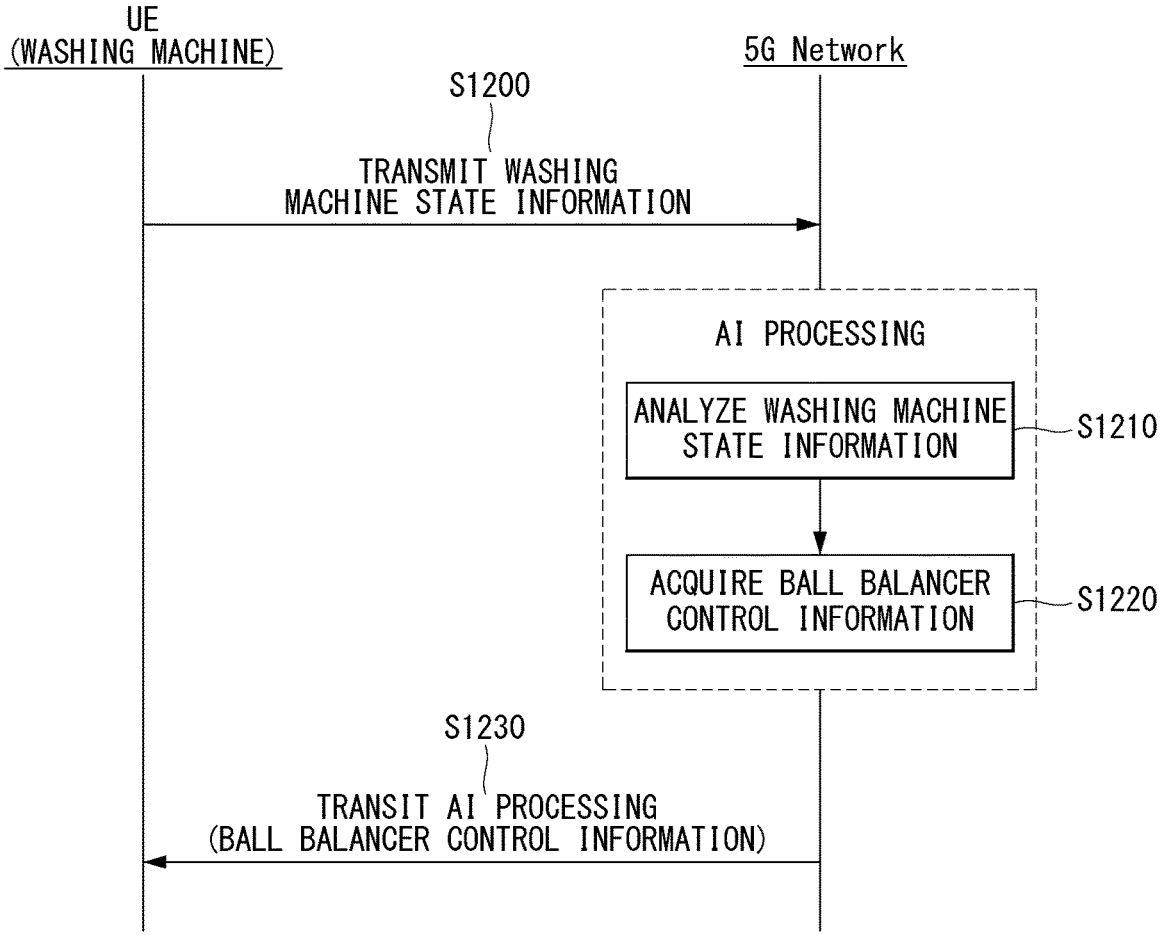
FIG. 12 is a flowchart showing an example of performing a laundry dewatering method using an artificial intelligence device according to an embodiment of the present disclosure.

FIG. 12 is a flowchart showing an example of performing a laundry dewatering method using an artificial intelligence device according to an embodiment of the present disclosure.

The controller 100 can control the communication unit to transmit the washing machine state information of the intelligent washing machine 100 to the AI processor included in the 5G network. Further, the controller 100 can control the communication unit to receive AI-processed information from the AI processor. The AI-processed information may be ball balancer control information.

The controller 100 can transmit washing machine state information related to the laundry driving operation acquired by the sensing unit 250 of the washing machine 10 on the basis of DCI to the network. The washing machine state information is transmitted to the network through a PUSCH, and DM-RSs of the SSB and the PUSCH can undergo QCK for a QCL type D.

Here, the 5G network may include an AI processor or an AI system and the AI system of the 5G network can perform AI processing on the basis of received information.

When sampling the operation information related to the operation of the washing machine and the position information related to the relative positions of the ball balancer and the laundry that are sensed by the sensing unit, the controller 100 generates and transmits washing machine state information to the 5G network by sampling them.

The AI system can analyze the washing machine state information received from the washing machine 10 (S1210). The AI system can acquire ball balancer control information for reducing noise due to rotating unbalance of the inner tub 211 on the basis of the result of analyzing the washing machine state information (S1220).

The 5G network can transmit the ball balancer control information calculated by the AI system to the washing machine 10 through a wireless communication unit (S1230).

Figure 13:
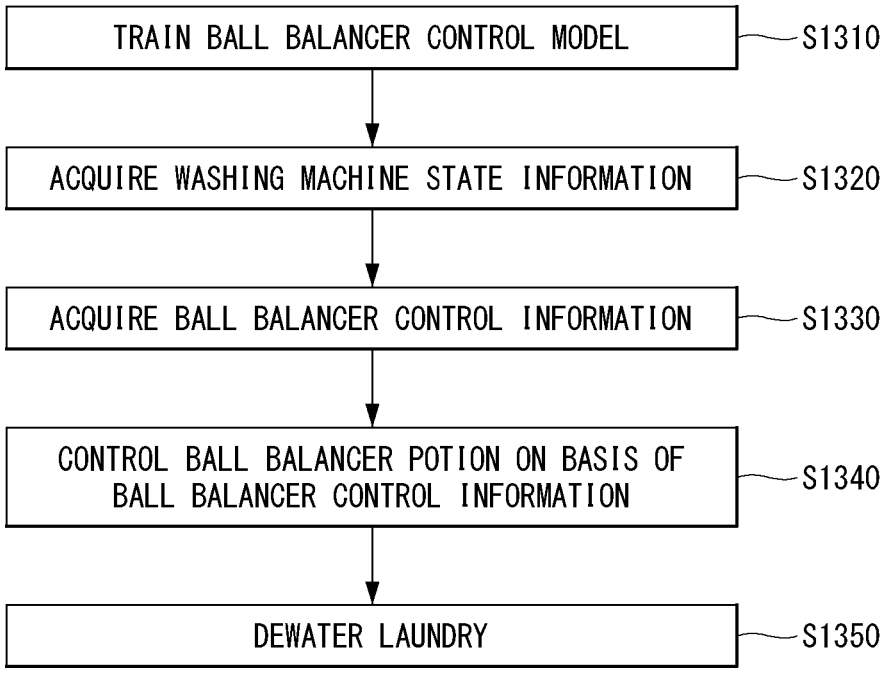
FIG. 13 is a flowchart showing an example of performing a laundry dewatering method using an artificial intelligence device according to an embodiment of the present disclosure.

FIG. 13 is a flowchart showing an example of performing a laundry dewatering method using an artificial intelligence device according to an embodiment of the present disclosure.

First, the controller 100 trains the ball balancer control model for acquiring first ball balancer control information related to position control in the inner tub 211 of the ball balancer positioned in the inner tub 211 (S1310).

Next, the controller 100 acquires first washing machine state information related to a dewatering operation of the washing machine.

Thereafter, the controller 100 acquires the first ball balancer control information by inputting the first washing machine state information to the trained ball balancer control model (S1330).

Nest, the controller 100 controls the position of the ball balancer in the inner tub on the basis of the acquired first ball balancer control information (S1340).

Finally, the controller 100 dewaters the laundry on the basis of the control result (S1350).

Embodiments to which the present disclosure can be applied.

Embodiment 1

A laundry dewatering method using an intelligent washing machine includes: training a ball balancer control model for acquiring first ball balancer control information related to position control in an inner tub of a ball balancer positioned in the inner tub; acquiring first washing machine state information related to a dewatering operation of the washing machine; acquiring the first ball balancer control information by inputting the first washing machine state information to the trained ball balancer control model; controlling a position of the ball balancer in the inner tub on the basis of the acquired first ball balancer control information; and dewatering the laundry on the basis of the control result.

Embodiment 2

In Embodiment 1, the controlling of a position may be repeatedly performed in a motor rotation speed value period having a first motor rotation speed value as a start point and a second motor rotation speed value as an end point.

Embodiment 3

In Embodiment 2, the method may further include, when a current motor rotation speed value of the washing machine reaches the second motor rotation speed value: acquiring and comparing a current vibration value of the washing machine with a predetermined critical vibration value; and changing the current motor rotation speed value on the basis of the comparing result.

Embodiment 4

In Embodiment 3, the dewatering of the laundry may further include increasing the current motor rotation speed value to a maximum motor rotation speed value that a motor of the washing machine supports, when the current vibration value is smaller than the critical vibration value.

Embodiment 5

In Embodiment 3, the dewatering of the laundry may further include decreasing the current motor rotation speed value of the washing machine to the first motor rotation speed value, when the current vibration value is larger than the critical vibration value.

Embodiment 6

In Embodiment 1, the acquiring of first washing machine state information may further include: acquiring operation information related to an operation of a motor of the washing machine and position information related to relative positions of the laundry and the ball balancer; and acquiring the first washing machine state information by sampling at least one of the operation information or the position information.

Embodiment 7

In Embodiment 6, the operation information may include at least one value of a current motor rotation speed value of the motor and a target motor rotation speed value.

Embodiment 8

In Embodiment 6, the position information may further include at least one of unbalance (UB) mass, a motor inflow current value, and a 6-axial gyro/acceleration sensor value.

Embodiment 9

In Embodiment 1, the training of a ball balancer control model may be repeatedly performed in a specific motor rotation speed value period having a first motor rotation speed value as a start point and a second motor rotation speed value as an end point, and may include: collecting a plurality of items of washing machine state information, which are data for training the ball balancer control model in the specific motor rotation speed value period, in the specific motor rotation speed value period; inputting the plurality of items of washing machine state information collected in the specific motor rotation speed value period into the ball balancer control model; controlling the ball balancer control model to set a certain motor rotation acceleration value as output for each of the plurality of items of input washing machine state information; and acquiring a ball balancer control information set that is information related to a specific motor rotation acceleration value for each of the plurality of items of washing machine state information, in which the specific motor rotation acceleration value may be an acceleration value for making a vibration value of the washing machine satisfy a target vibration value when the motor rotation speed of the washing machine reaches a second specific motor rotation value.

Embodiment 10

In Embodiment 9, the acquiring of a ball balancer control information set may include applying a reward to the ball balancer control model on the basis of whether the vibration value satisfies the target vibration value when the current moor rotation speed value of the washing machine reaches the second motor rotation speed value, in which the ball balancer control model to which the reward is applied may update the plurality of items of washing machine state information included in the ball balancer control information set and the specific motor rotation acceleration values respectively related to the plurality of items of washing machine state information on the basis of the reward.

Embodiment 11

In Embodiment 1, the acquiring of first ball balancer control information may further include receiving DCI (Downlink Control Information), which is used for scheduling transmission of the first washing machine state information, from a network, in which the first washing machine state information may be transmitted to the network on the basis of the DCI.

Embodiment 12

In Embodiment 11, the method may further include performing a procedure for initial connection with the network on the basis of an SSB (Synchronization signal block), in which the first washing machine state information may be transmitted to the network through a PUSCH (Physical Uplink Shared Channel), and DM-RSs (Dedicated demodulation Reference Signal) of the SSB and the PUSCH may have undergone QCK (Quasi-Co Location) for a QCL type D.

Embodiment 13

In Embodiment 11, the method may further include: controlling a communication unit to transmit the first washing machine state information to an AI processor included in the network; and controlling the communication unit to receive AI-processed information from the AI processor, in which the AI-processed information may be the first ball balancer control information.

Embodiment 14

An intelligent washing machine that performs laundry dewatering, includes: an inner tub in which laundry is received; a motor transmitting torque to the inner tub; a ball balancer positioned in the inner tub; a sensing unit; a communication unit; and a controller training the ball balancer control model for acquiring first ball balancer control information related to position control in the inner tub of a ball balancer positioned in the inner tub, acquiring first washing machine state information related to a dewatering operation of the washing machine, acquiring the first ball balancer control information by inputting the first washing machine state information to the trained ball balancer control model, controlling a position of the ball balancer in the inner tub on the basis of the acquired first ball balancer control information, and dewatering the laundry on the basis of the control result.

Embodiment 15

In Embodiment 14, the position of the ball balancer in the inner tub may be repeatedly performed in a motor rotation speed value period having a first motor rotation speed value as a start point and a second motor rotation speed value as an end point.

Embodiment 16

In Embodiment 15, when a current motor rotation speed value of the washing machine reaches the second motor rotation speed value, the controller may acquire and compare a current vibration value of the washing machine with a predetermined critical vibration value, and may change the current motor rotation speed value on the basis of the comparing result.

Embodiment 17

In Embodiment 16, the controller may repeatedly perform control of the position of the ball balancer in a motor rotation speed value period having a first motor rotation speed value as a start point and a second motor rotation speed value as an end point.

Embodiment 18

In Embodiment 16, the controller may dewater the laundry by decreasing the current motor rotation speed value of the washing machine to the first motor rotation speed value, when the current vibration value is larger than the critical vibration value.

Embodiment 19

In Embodiment 14, the controller may acquire operation information related to an operation of a motor of the washing machine and position information related to relative positions of the laundry and the ball balancer, and may acquire the first washing machine state information by sampling at least one of the operation information or the position information.

Embodiment 20

In Embodiment 19, the operation information may include at least one value of a current motor rotation speed value of the motor and a target motor rotation speed value.

Embodiment 21

In Embodiment 19, the position information may further include at least one of unbalance (UB) mass, a motor inflow current value, and a 6-axial gyro/acceleration sensor value.

Embodiment 22

In Embodiment 14, the controller may dewater the laundry by decreasing the current motor rotation speed value of the washing machine to the first motor rotation speed value, when the current vibration value is larger than the critical vibration value.

Embodiment 23

In Embodiment 22, the controller may apply a reward to the ball balancer control model on the basis of whether the vibration value satisfies the target vibration value when the current moor rotation speed value of the washing machine reaches the second motor rotation speed value, in which the ball balancer control model to which the reward is applied may acquire the ball balancer control information set by updating the plurality of items of washing machine state information included in the ball balancer control information set and the specific motor rotation acceleration values respectively related to the plurality of items of washing machine state information on the basis of the reward.

Embodiment 24

In Embodiment 14, the controller, in order to acquire the first ball balance control information, may receive DCI (Downlink Control Information), which is used for scheduling transmission of the first washing machine state information, from a network, and the first washing machine state information may be transmitted to the network on the basis of the DCI.

Embodiment 25

In Embodiment 24, the controller may perform a procedure for initial connection with the network on the basis of an SSB (Synchronization signal block), and the first washing machine state information may be transmitted to the network through a PUSCH (Physical Uplink Shared Channel), and DM-RSs (Dedicated demodulation Reference Signal) of the SSB and the PUSCH may have undergone QCK (Quasi-Co Location) for a QCL type D.

Embodiment 26

In Embodiment 24, the controller may control a communication unit to transmit the first washing machine state information to an AI processor included in the network and may control the communication unit to receive AI-processed information from the AI processor, and the AI-processed information may be the first ball balancer control information.

Effects of the laundry dewatering method using an intelligent washing machine according to the present disclosure are as follows. According to at least one of embodiments of the present disclosure, the present disclosure can prevent generation of rotating unbalance of the inner tub due to wet laundry not uniformly received in the inner tub of a washing machine.

Further, according to at least one of embodiments of the present disclosure, it is possible to train a model for position control of the ball balancer by acquiring data obtained by sampling information related to the state of wet laundry and the operation of the inner tub of the washing machine.

Effects of an intelligent washing machine according to the present disclosure are as follows. According to at least one of embodiments of the present disclosure, the present disclosure can prevent generation of rotating unbalance of the inner tub due to wet laundry not uniformly received in the inner tub of a washing machine.

Further, according to at least one of embodiments of the present disclosure, it is possible to train a model for position control of the ball balancer by acquiring data obtained by sampling information related to the state of wet laundry and the operation of the inner tub of the washing machine.

The present disclosure can be achieved as computer-readable codes on a program-recoded medium. A computer-readable medium includes all kinds of recording devices that keep data that can be read by a computer system. For example, the computer-readable medium may be an HDD (Hard Disk Drive), an SSD (Solid State Disk), an SDD (Silicon Disk Drive), a ROM, a RAM, a CD-ROM, a magnetic tape, a floppy disk, and an optical data storage, and may also be implemented in a carrier wave type (for example, transmission using the internet). Accordingly, the detailed description should not be construed as being limited in all respects and should be construed as an example. The scope of the present disclosure should be determined by reasonable analysis of the claims and all changes within an equivalent range of the present disclosure is included in the scope of the present disclosure.

The features, structures, effects, etc. described in the above embodiments are included in at least one embodiment of the present disclosure, but are not necessarily limited to only one embodiment. Further, the features, structures, effects, etc. exemplified in each embodiment may be combined or modified also in other embodiments by those skilled in the art to which the embodiment are pertained. Accordingly, configurations related to the combinations and modifications should be construed as being included in the range of the present disclosure.

Although the present disclosure was described above with reference to embodiments, the embodiments are only examples and do not limit the present disclosure, and those skilled in the art would know that the present disclosure may be changed and modified in various ways not exemplified above without departing from the scope of the present disclosure. For example, the components described in detail in the embodiments of the present disclosure may be modified. Further, differences relating to the changes and modifications should be construed as being included in the scope of the present disclosure which is determined by claims.

Effects of a laundry drying method using an artificial intelligence device according to an embodiment of the present disclosure and an apparatus for the method are as follows.

According to the present disclosure, there in an effect that it is possible to prevent generation of rotating unbalance of the inner tub due to wet laundry not uniformly received in the inner tub of a washing machine.

Further, the present disclosure can train a model for position control of the ball balancer by acquiring data obtained by sampling information related to the state of wet laundry and the operation of the inner tub of the washing machine.

The effects of the present disclosure are not limited to the effects described above and other effects can be clearly understood by those skilled in the art from the following description.

What is claimed is:

1. A laundry dewatering method using an intelligent washing machine, the method comprising:

training a ball balancer control model for acquiring first ball balancer control information related to position control of a ball balancer in an inner tub;

acquiring first washing machine state information related to a dewatering operation of the washing machine;

acquiring the first ball balancer control information by inputting the first washing machine state information to the trained ball balancer control model;

controlling a position of the ball balancer in the inner tub based on the acquired first ball balancer control information; and dewatering the laundry based on a result of controlling the position of the ball balancer in the inner tub.

2. The method of claim 1, wherein the controlling of a position is repeatedly performed in a motor rotation speed value period having a first motor rotation speed value as a start point and a second motor rotation speed value as an end point.

3. The method of claim 2, further comprising, when a current motor rotation speed value of the washing machine reaches the second motor rotation speed value:

acquiring and comparing a current vibration value of the washing machine with a predetermined critical vibration value; and changing the current motor rotation speed value based on a result of comparing the current vibration value of the washing machine with the predetermined critical vibration value.

4. The method of claim 3, wherein the dewatering of the laundry includes increasing the current motor rotation speed value to a maximum motor rotation speed value that a motor of the washing machine supports, when the current vibration value is smaller than the critical vibration value.

5. The method of claim 3, wherein the dewatering of the laundry includes decreasing the current motor rotation speed value of the washing machine to the first motor rotation speed value, when the current vibration value is larger than the critical vibration value.

6. The method of claim 1, wherein the acquiring of first washing machine state information includes:

acquiring operation information related to an operation of a motor of the washing machine and position information related to relative positions of the laundry and the ball balancer; and acquiring the first washing machine state information by sampling at least one of the operation information or the position information.

7. The method of claim 6, wherein the operation information includes at least one value of a current motor rotation speed value of the motor and a target motor rotation speed value.

8. The method of claim 6, wherein the position information includes at least one of unbalance (UB) mass, a motor inflow current value, and a 6-axial gyro/acceleration sensor value.

9. The method of claim 1, wherein the training of a ball balancer control model is repeatedly performed in a specific motor rotation speed value period having a first motor rotation speed value as a start point and a second motor rotation speed value as an end point, and includes:

collecting a plurality of items of washing machine state information, which are data for training the ball balancer control model in the specific motor rotation speed value period, in the specific motor rotation speed value period;

inputting the plurality of items of washing machine state information collected in the specific motor rotation speed value period into the ball balancer control model;

controlling the ball balancer control model to set a certain motor rotation acceleration value as output for each of the plurality of items of input washing machine state information; and acquiring a ball balancer control information set that is information related to a specific motor rotation acceleration value for each of the plurality of items of washing machine state information, and the specific motor rotation acceleration value is an acceleration value for making a vibration value of the washing machine satisfy a target vibration value when the motor rotation speed of the washing machine reaches a second specific motor rotation value.

10. The method of claim 9, wherein the acquiring of a ball balancer control information set includes applying a reward to the ball balancer control model based on whether the vibration value satisfies the target vibration value when the current motor rotation speed value of the washing machine reaches the second motor rotation speed value, and the ball balancer control model to which the reward is applied updates the plurality of items of washing machine state information included in the ball balancer control information set and the specific motor rotation acceleration values respectively related to the plurality of items of washing machine state information based on the reward.

11. The method of claim 1, wherein the acquiring of first ball balancer control information further includes receiving DCI (Downlink Control Information), which is used for scheduling transmission of the first washing machine state information, from a network, and the first washing machine state information is transmitted to the network based on the DCI.

12. The method of claim 11, further comprising performing a procedure for initial connection with the network based on an SSB (Synchronization signal block), wherein the first washing machine state information is transmitted to the network through a PUSCH (Physical Uplink Shared Channel), and DM-RSs (Dedicated demodulation Reference Signal) of the SSB and the PUSCH have undergone QCK (Quasi-Co Location) for a QCL type D.

13. The method of claim 11, further comprising:

controlling a communication unit to transmit the first washing machine state information to an AI processor included in the network; and controlling the communication unit to receive AI-processed information from the AI processor, wherein the AI-processed information may be the first ball balancer control information.

* * * * *